United States Patent [19]

Welden

[11] 4,354,481

[45] Oct. 19, 1982

[54] HEATING APPARATUS

[76] Inventor: David P. Welden, North Indiana Ave., Iowa Falls, Iowa 50126

[21] Appl. No.: 182,853

[22] Filed: Sep. 2, 1980

[51] Int. Cl.[3] ..... F24H 1/00

[52] U.S. Cl. ..... 126/350 B; 126/359; 122/10; 219/276

[58] Field of Search ..... 126/350 B, 355, 359, 126/101, 348, 369.2, 369.1, 360 R, 360 A; 219/276, 273, 271, 281, 428; 159/16 R, 4 CC; 122/5.5 A, 10, 36, 139, 487

[56] References Cited

U.S. PATENT DOCUMENTS

| | | | |
|---|---|---|---|
| 1,258,652 | 3/1918 | Clarke | 126/350 B |
| 2,038,773 | 4/1936 | Turnquist | 126/350 B |
| 3,645,007 | 2/1972 | Scott | 219/276 X |
| 4,003,967 | 1/1977 | Potvin | 219/276 X |

FOREIGN PATENT DOCUMENTS

| | | | |
|---|---|---|---|
| 398490 | 4/1923 | Fed. Rep. of Germany | 122/5.5 A |
| 143086 | 5/1920 | United Kingdom | 126/359 |
| 186897 | 5/1923 | United Kingdom | 126/355 |

*Primary Examiner*—Samuel Scott
*Assistant Examiner*—Randall L. Green
*Attorney, Agent, or Firm*—Henderson & Sturm

[57] ABSTRACT

A heating apparatus having a chamber, an air inlet attached to the chamber, an air outlet attached to a bottom portion of the chamber, a heater attached to the chamber for introducing heat into the chamber, a blower for causing air to enter the inlet, pass through the chamber and exit through the outlet, nozzles for introducing water into the chamber from the top thereof, and water catching units disposed below the water inlet for holding water in pools in the chamber and preventing all of the water from passing directly out of the outlet.

7 Claims, 5 Drawing Figures

HEATING APPARATUS

BACKGROUND OF THE INVENTION

The present invention relates generally to heaters and more particularly to heaters having apparatus attached thereto for introducing water into such heater for carrying more heat out the outlet thereof for drying and curing purposes.

In the art of curing concrete products, a common type of heater used is a boiler sending steam heat to a heat distributing network underneath the concrete to be cured. The disadvantages of this type of a heating system were discussed in U.S. Pat. No. 4,147,323 to Welden. In that patent, a linear type of heater and heat distributing network was disclosed of a type wherein the products of combustion are distributed with the air blown through the heater rather than allowing this heat to be wasted by going up a stack. This type of a linear heater can be used for anything that can tolerate the by-products of combustion; for example, in curing cement block, concrete pipe, pre-stressed concrete structures, etc.

While it has been discovered that this type of linear heater discussed above is much more efficient than prior art heat systems, the efficiency of such a heater, it has been found by the present inventor, can be increased considerably by introducing water to the air passing through such heater so that the air can deliver much more heat for each amount of air delivered.

In the development of trying to produce a linear heater and introducing steam thereto, private experiments by the present inventor were conducted. First of all, it was determined that if the heating chamber was vertically oriented that the water passed straight out the bottom before being completely vaporized, and slugs of water went out the outlet pipe and thereby interferred with the curing of the concrete product.

In an attempt to overcome this problem, in still further private experiments by the inventor, a horizontally disposed heating chamber was experimentally used and it was discovered that water tended to accumulate in the bottom of such heating chamber and that surges of water pulsated out of the outlet from time to time which was, again, undesirable since the concrete would not cure properly under such circumstances.

Accordingly, it was established by these experiments that there is a need for an apparatus for introducing water into the heating chamber of such a heat furnace long enough to be sure that it is vaporized, and allowing water to always be present in the heating chamber to be sure that the heater is operating at optimum efficiency, while at the same time preventing surges of water out of the outlet of such heating chamber.

SUMMARY OF THE INVENTION

The present invention relates to a heating apparatus of a type wherein the products of combustion pass through and are delivered with the heated air and having a heating chamber but no exhaust stack. An air inlet is attached to the chamber and an air outlet is attached to a bottom portion of the chamber. A heater is attached to the chamber for introducing heat into the chamber. A blower is connected to the chamber for causing air to enter the inlet, pass through the chamber and exit through the outlet. Water nozzles are provided for introducing water into the chamber from the top thereof, and water catching units are disposed below the water inlet for holding water in pools in the chamber and preventing all of the water from passing directly out of the outlet.

An object of the present invention is to provide an improved linear heating apparatus.

Another object of the invention is to provide a heater for curing concrete or the like having a structure for introducing water thereto for increasing heat carrying capability of the air passing through the heater.

Another object of the present invention is to provide a water introducing structure for the heater of the type identified above which allows water to always be present in the heating chamber thereof, while at the same time preventing surges of water out of the outlet of the heating chamber.

Still another object of the present invention is to provide a pre-heater for the heating apparatus of the general type described above.

A still further object of the present invention is to provide a water introducing structure which tends to facilitate quick evaporation of water into steam.

Other objects, advantages, and novel features of the present invention will become apparent from the following detailed description of the invention when considered in conjunction with the accompanying drawings.

DESCRIPTION OF THE PREFERRED EMBODIMENT

Figure 1:
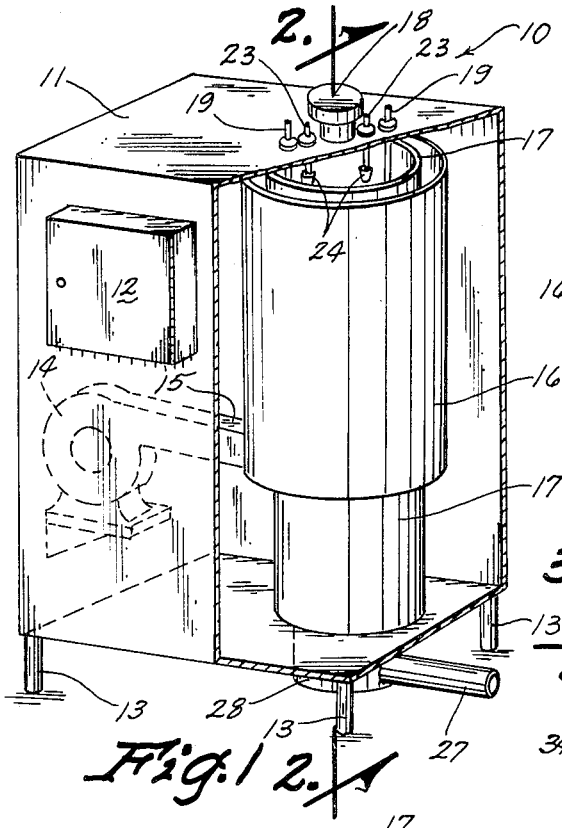
FIG. 1 shows a perspective view of the apparatus of the present invention, being cut-away at a portion thereof to show the interior of the heater.

Referring now to the drawings wherein like reference numerals designate identical or corresponding parts throughout the several views, FIG. 1 shows a heating apparatus 10 constructed in accordance with the present invention.

The heater 10, shown in FIG. 1, includes a generally sealed housing 11 having a control box 12 disposed thereon. A plurality of legs 13 are provided for supporting the housing 11 up off of the ground or floor. A blower 14 is provided for blowing air from outside of the housing 11 into a pre-heating chamber 16 having a cylindrical configuration in the preferred embodiment shown. A heating chamber 17 is provided inside of the pre-heating chamber 14. A safety blow-off valve 18 is attached to the sealed housing 11 above the heating chamber 17 such that when the pressure exceeds a predetermined amount within the housing 11, or within the heating chamber, the pressure will be relieved by the safety valve 18.

Figure 4:
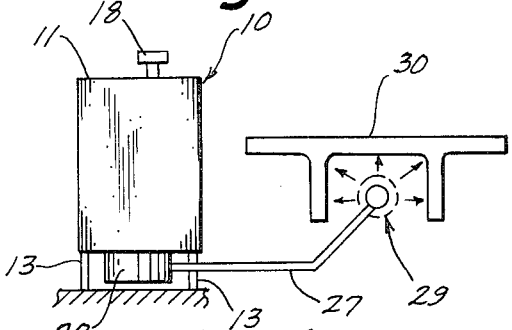
FIG. 4 is a schematic view of the present invention in use for curing pre-stressed concrete products.

Gas tubes 19 are sealingly attached through the housing 11 and extend down into the heating chamber 17 and have burner nozzles 21 attached thereto for creating a heating flame 22. Water pipes 23 also are sealingly attached to the housing 11 and extend therethrough to water nozzles 24, which have jets of water 26 emanating therefrom. The extreme top of the heating chamber 17 serves as the inlet for the heating chamber 17. An outlet pipe 27 is attached to the bottom of the cylindrical heating chamber 17 by means of a second chamber wall 28 which directs the heated, steam laden air and by-products of combustion out to a heat distributing device 29, for exmaple, as shown in FIG. 4 and disclosed in more detail in U.S. Pat. No. 4,147,323 to Welden.

Figure 2:
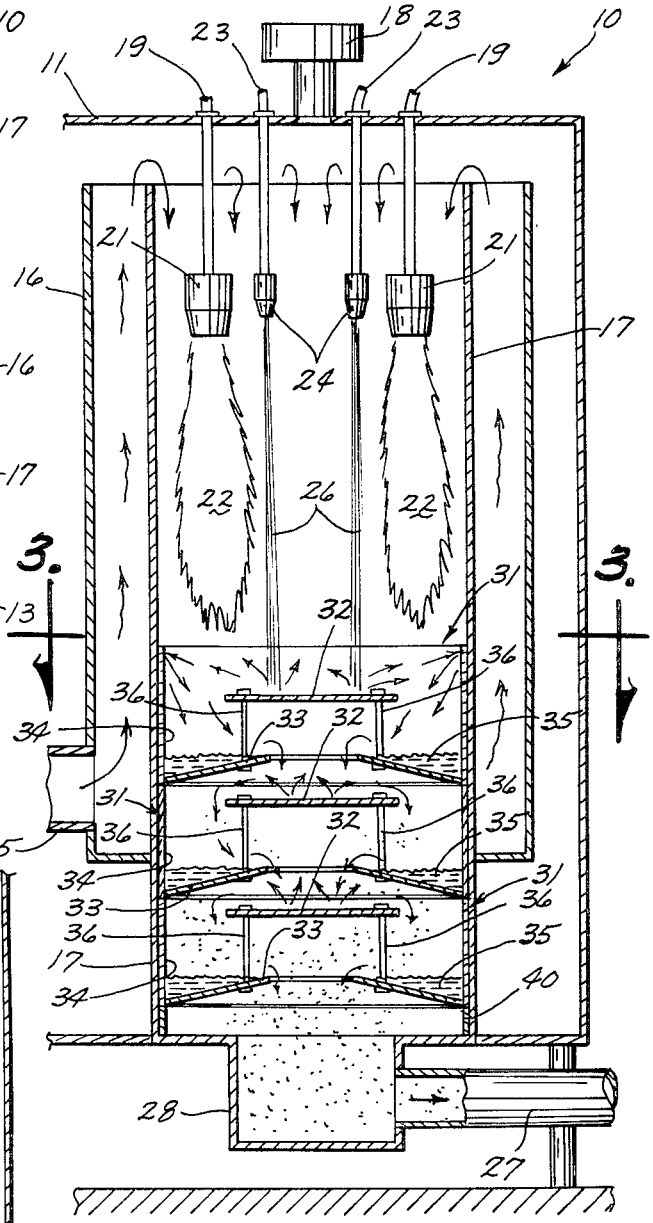
FIG. 2 is a partial enlarged cross-sectional view taken along line 2—2 of FIG. 1.
Figure 3:
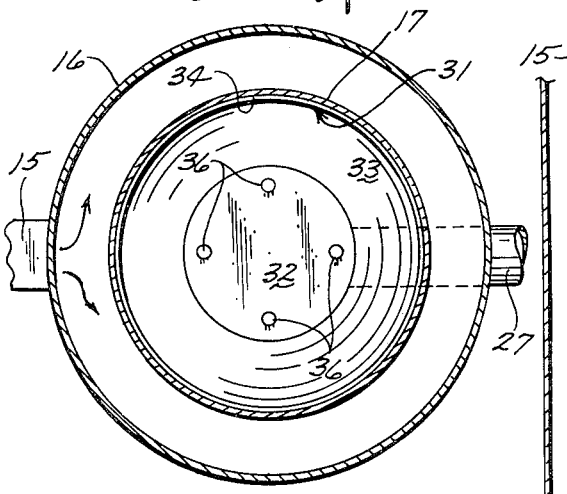
FIG. 3 is a partial enlarged cross-sectional view taken along line 3—3 of FIG. 2.
Figure 5:
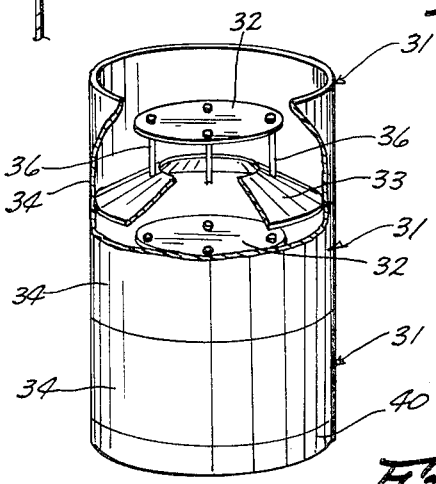
FIG. 5 is a perspective view of the water dispersing and collecting apparatus shown within the heating chamber of FIGS. 2 and 3.

A plurality of rigid water catching sections 31, as clearly shown in FIGS. 2, 3 and 5, are provided for reasons which will be outlined below. Each of these rigid water catching sections 31 include a top plate 32, attached to an upwardly and inwardly extending annular member 33, which is further connected to an outer cylindrical member 34 which is of such a size that it will slide into place in the heating chamber 17, and, such that these rigid sections 31 will stack on top of each other. Whatever number of sections 31 desired for a particular application can be used without any significant modification to the basic design. A plurality of bolts 36 are provided for spacing the plates 32 with respect to the annular members 33 as will be clear from viewing FIGS. 2, 3 and 5. An optional cylindrical ring 40 is shown in FIG. 2 for spacing sections 31 upwardly above the bottom of the chamber formed by walls 17.

In operation, the invention 10 would be attached to the distributing device 29, for example, as shown in FIG. 4, as described in more detail in U.S. Pat. No. 4,147,323 to Welden. This heat distributing device 29 can be under a pre-stressed concrete section 30 or the like which needs to be cured, or under any other member that needs to be cured and which can tolerate the heat and the by-products of combustion within the type of furnace disclosed within this application. The outlet pipe 27, as can be seen in FIG. 4, is connected directly to the heat distributing device 29.

The controls within the box 12, which are of well-known design, are appropriately activated when the device is to be used such that the blower 14 will be turned on to an appropriate speed, for example, such that it could deliver 600 CFM of air flow through the chamber 17. In like manner, the burners 21 would be lit so as to have a flame 22, for example as shown in FIG. 2, and the water nozzles 24 would be activated such that the jet of water 26 is emanating therefrom. Then, consequently, the air from the outside would be introduced to the outside of the housing 11 through the blower 14 and in through a duct 15 and into the pre-heater 16. Because the walls 17 are extremely hot, the air passing up through the pre-heater 16 becomes hot also, the air is thereby pre-heated before it goes up and over, as indicated by the arrows in FIG. 2, and into the top inlet tube to the cylindrical heating chamber 17. In general, the inclusion of the pre-heater 16 and the sealed housing 11 are designed to retain most of the heat which would otherwise be radiated to the atmosphere and be lost if the heating chamber 17 were to be used out in the open and without the members 16 and the housing 11 thereround. Also, preventing these metal parts from getting too hot gives these parts a longer life.

The water 26 which is passing out of the nozzles 24 splashes upon the top flat horizontal plate 32 and splashes, as indicated by the arrows in FIG. 2, over to the side and down and around and thereby tends to form small water particles which are readily converted into steam because of this situation. Furthermore, small pools 35 of water are formed above each of the annular plates 33, and this tends to assure that some water is always present in this structure. If these begin to dry up too quickly, certain adjustments can be made, for example by either increasing water flow, decreasing the amount of heat, stacking in more rigid sections 31 so as to accumulate more water, or the like.

The desired result, as outlined above, is to provide that water will always be present in the heating chamber so as to continuously add steam to the air passing through the heater so as to improve the efficiency of transferring the heat from the burners 22 to the product 30 to be cured. On the other hand, the desire is also to see that water does not overflow into the outlet pipe 27 and be delivered to the heat distributing apparatus 29, since delivery of water to the heat distributing apparatus tends to cause it to malfunction.

Obviously many modifications and variations of the present invention are possible in light of the above teachings. It is therefore to be understood that, within the scope of the appended claims, the invention may be practiced otherwise then as specifically described.

I claim:

1. Heating apparatus comprising:

chamber means for forming a chamber, said chamber means being generally cylindrically shaped;

air inlet means attached to said chamber means;

air outlet means attached to a bottom portion of said chamber means;

heater means attached to said chamber means for introducing heat into said chamber;

blower means for causing air to enter said inlet means, pass through said chamber, and exit through said outlet means;

means for introducing water into said chamber from a top portion thereof; and water catching means disposed below said water inlet means for holding said water in pools in said chamber and preventing all of said water from passing directly out of said outlet means, said water catching means comprising:

a horizontally and axially centrally disposed plate means located below said water introducing means for preventing water from said water introducing means to pass directly to said outlet means;

annular means sealingly and operably attached to the inner wall of said chamber means and extending upwardly and radially inwardly with respect to the axis of the cylindrical chamber means to a point directly below said plate means, a central portion of said annular means having an opening therein for allowing air and water to pass therethrough; and means for attaching the plate means to the annular means for holding the plate means above said annular means and for allowing air and water to pass between the plate means and the annular means and through said opening in the annular means.

2. The apparatus of claim 1 including a cylindrical member disposed within said cylindrically shaped chamber means and being sealingly and rigidly attached to the outer periphery of said annular means to thereby cause the cylindrical member, annular means and plate means to form a first rigid section.

3. The apparatus of claim 2 including a second rigid section substantially identical to said first rigid section, and being disposed within said cylindrically shaped chamber means below said first rigid section.

4. The apparatus of claim 3 including a third rigid section substantially identical to the first rigid section, and being disposed below said second rigid section, whereby water introduced by said water means can pass over the plate means of the first rigid section to the first annular means, from the first annular means to the second rigid section having a second plate means and a second annular means; and from the second annular means to the third rigid section having a third plate means and a third annular means, whereby the water from said water introducing means is prevented from passing directly out through said outlet means and tends to become substantially vaporized before leaving said outlet means.

5. The apparatus of claim 1 including a cylindrically shaped pre-heater means disposed around said chamber means, said blower means being in communication with said pre-heater means and said pre-heater means being in communication with said chamber means whereby air from said blower means is forced through said pre-heater means and thereby is heated by the hot walls of said chamber means and on to said chamber means, past said water catching means and out said outlet means.

6. The apparatus of claim 5 wherein said heater means includes at least one burner disposed in the top of said chamber means.

7. The apparatus of claim 6 wherein said means for introducing water into the chamber means includes at least one nozzle means disposed in the top of said chamber means for directing a stream of water onto said water catching means.

* * * * *